United States Patent [19]

Green

[11] 4,019,687

[45] Apr. 26, 1977

[54] AEROSOL VALVE AND SPRAYHEAD

[76] Inventor: Edward H. Green, 11 Army Trail Road, Addison, Ill. 60101

[22] Filed: Mar. 21, 1975

[21] Appl. No.: 560,877

Related U.S. Application Data

[63] Continuation of Ser. No. 304,695, Oct. 8, 1972, abandoned, which is a continuation of Ser. No. 122,935, March 10, 1971, abandoned.

[52] U.S. Cl. ..... 239/573; 239/579; 222/394; 222/402.24

[51] Int. Cl.[2] ..... B05B 1/30

[58] Field of Search ..... 239/337, 373, 573, 579; 222/394, 402.24

[56] References Cited

UNITED STATES PATENTS

| | | | |
|---|---|---|---|
| 2,789,012 | 4/1957 | Bretz | 239/573 |
| 2,797,965 | 7/1957 | McKernan | 239/573 X |
| 2,913,154 | 11/1959 | Kuffer | 239/573 X |
| 3,074,601 | 1/1963 | Kuffer | 239/573 X |
| 3,098,589 | 7/1963 | Graham | 222/402.24 X |
| 3,145,011 | 8/1964 | Kappel | 239/579 X |
| 3,146,922 | 9/1964 | Tuttle | 239/579 X |
| 3,206,082 | 9/1965 | Green | 239/573 X |
| 3,231,153 | 1/1966 | Green et al. | 239/573 X |
| 3,608,830 | 9/1971 | Ramella | 239/573 X |
| R24,981 | 5/1961 | Bretz | 239/573 X |

FOREIGN PATENTS OR APPLICATIONS

| | | | |
|---|---|---|---|
| 1,244,457 | 9/1960 | France | 222/402.24 |
| 324,907 | 11/1957 | Switzerland | 222/402.24 |
| 832,507 | 4/1960 | United Kingdom | 222/402.24 |

*Primary Examiner*—Robert S. Ward, Jr.
*Attorney, Agent, or Firm*—Perry Carvellas

[57] ABSTRACT

An aerosol spray valve of the type which utilizes a reciprocable plunger moving within a valve housing that is in turn mounted to a cover member. The cover member is adapted to be crimped to a canister and has a dip tube extending from the interior of the valve housing to the bottom of the canister. Pressurized product is forced from the interior of the canister through the dip tube into the valve housing and out of the cover member through a central hole into a sprayhead that is mounted in the hole. An annular elastomeric gasket surrounds the hole and the upper end of the reciprocable plunger forms a valve seat that is spring-biased against the underside of the gasket to prevent pressurized product from emerging. The sprayhead has an associated stem that enters a socket formed in the plunger, the stem being slidably and sealingly engaged through the hole and the passageway in the elastomeric gasket. The stem is imperforate. The socket of the plunger has channel means formed in its interior wall along the vertical length thereof so that there are one or more passageways formed between the outer surface of the stem and the socket to transport the pressurized product. The pressurized product enters at the top of the plunger when the valve seat is unseated from the elastomeric gasket, passing through the passageways to the bottom of the plunger on the interior thereof, and then into the hollow bore of the stem from where it is conveyed to the button of the sprayhead and out to the atmosphere when the button is depressed. The bottom end of the stem is spaced above the bottom floor of the socket or a continuation of the side channels is provided in the floor. The stem may be separable from the button of the sprayhead or may be integral therewith. If separable, the stem is permanently engaged in the socket. The resulting structure provides accurate metering of the pressurized product.

8 Claims, 18 Drawing Figures

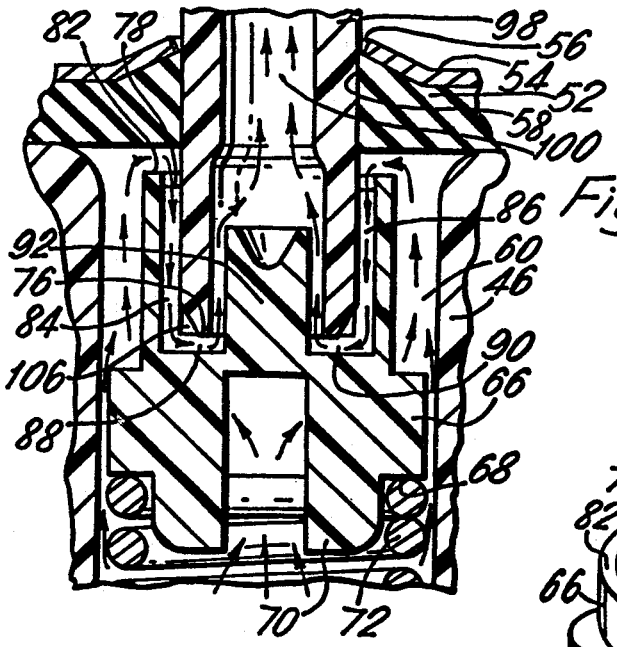
Fig. 4.
Fig. 5.
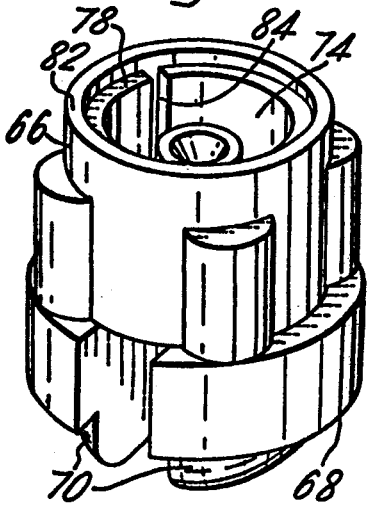
Fig. 6.
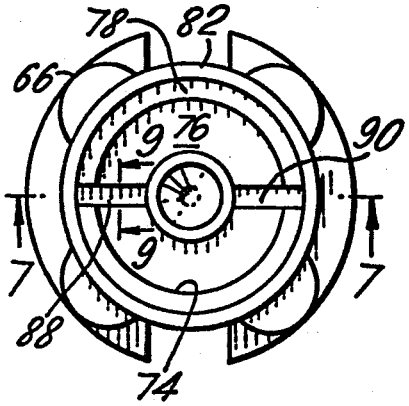
Fig. 7.
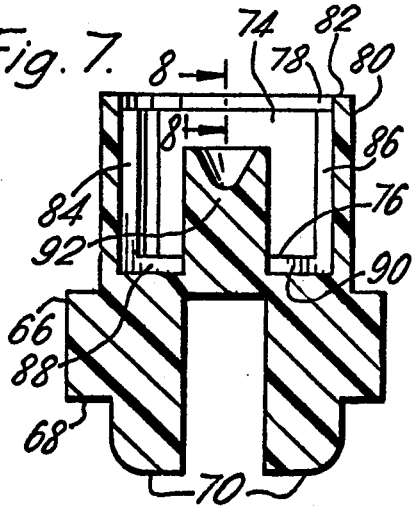
Fig. 8.
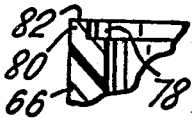
Fig. 9.
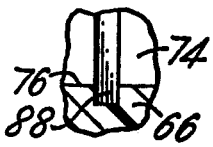

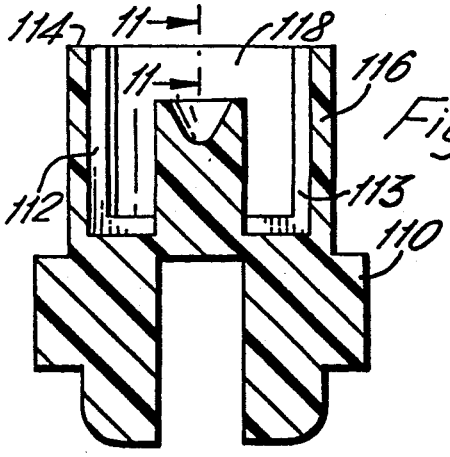
Fig. 10.
Fig. 11.
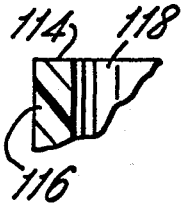
Fig. 12.
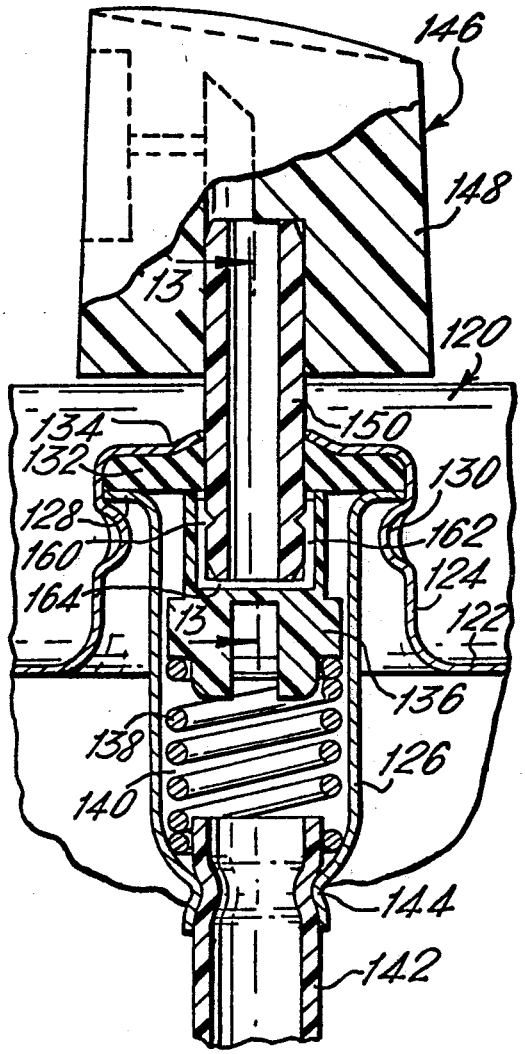
Fig. 13.
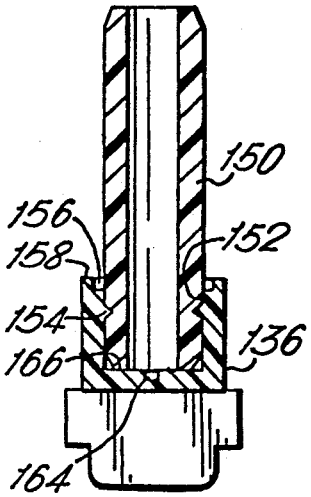

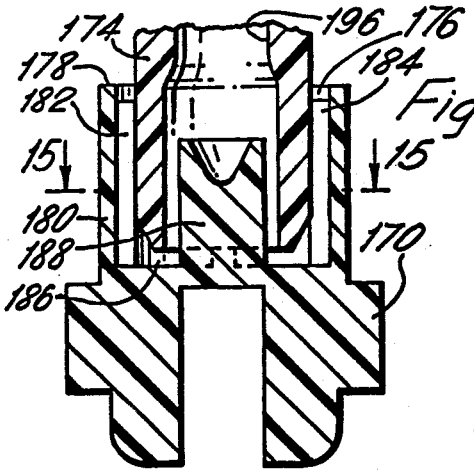
Fig. 14.
Fig. 15.
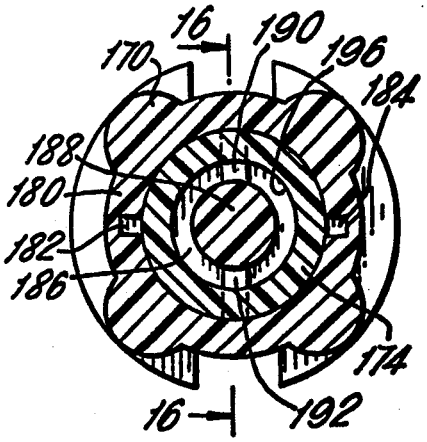
Fig. 16.
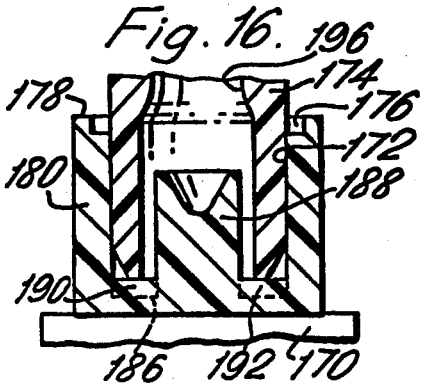
Fig. 17.
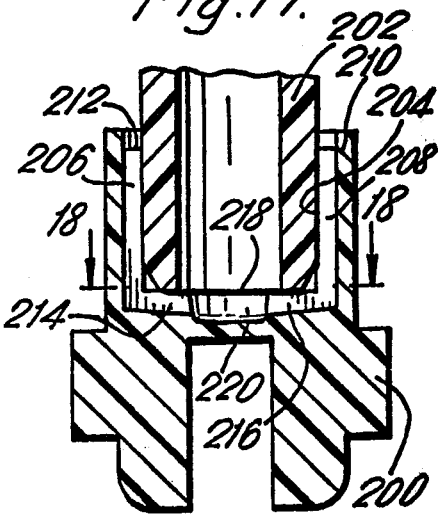
Fig. 18.
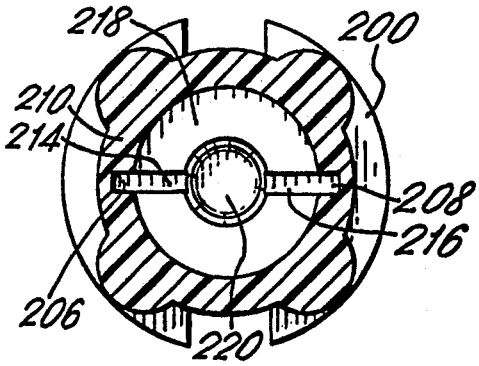

AEROSOL VALVE AND SPRAYHEAD

This is a continuation of application Ser. No. 304,695 filed Oct. 8, 1972 which application is a continuation of Ser. No. 122,935, filed Mar. 10, 1971, both now abandoned.

BACKGROUND OF THE INVENTION

The invention herein relates to aerosol valves and more particularly is concerned with a novel valve construction for a pressurized package in which the metering of the pressurized product remains constant for the life of the package and may be accurately established at the time of manufacture of the valve.

Aerosol valves are generally of two types, namely those in which there is a stem protruding from the package and a button is removably mounted on the stem, and those in which the stem and button are integral to provide a sprayhead that may be totally removed from the package. Somewhat different techniques are used in gassing the two types. The invention herein is applicable to both types of aerosol valves and a principal attribute of the invention, namely accurate metering, is available for both constructions. Other advantages will be described in connection with the respective types.

The so-called aerosol package of the present time is a canister or bottle of robust construction capable of sustaining relatively high internal pressures, having some material therein which is to be atomized or sprayed, this material being suspended in or mixed with a propellant. The propellant is usually gas having a low boiling point maintained under pressure. The canister or bottle is provided with an opening in its upper end and a valve assembly is mounted in this opening.

The preferred embodiments of the invention will be described herein as mounted to canisters, but it should be kept in mind that the invention is equally advantageous when the container for the pressurized product is a bottle.

Since the manufacturing techniques for canisters on the one hand and valve assemblies on the other hand are quite different, the one who assembles the packages, called a filler, purchases the valve assemblies and canisters separately and assembles them on his own production line. The opening in the canister has a rolled edge and the valve assembly includes a cover member that fits over the opening and is crimped in place. Filling of the package is accomplished with several different techniques, depending upon the nature of the product and its propellant, the type of filling equipment which the filler has, and the construction of the valve. Most economical types of filling techniques are those by means of which the package is gassed after it is completed, at room temperature directly through the valve.

The valve assembly which the filler purchases from the manufacturer comprises a metal cover member which has a downwardly opening annular partially rolled edge that engages over the rolled edge of the opening of the canister, there being some gasketing compound baked into the rolled edge of the cover member so that when crimped in place a permanent seal will be formed. The cover member has a central upwardly protruding boss surrounded by a well of annular configuration, the boss protruding almost to the same level as the rolled edge of the cover member. It has a center opening into which the stem of the sprayhead is adapted to pass. As used in this specification, the sprayhead will be considered to be composed of a button and a stem, whether integral or separate.

On its underside, the boss of the cover member has the upper end of a valve housing crimped thereinto, with a disc-like annular gasket member of elastomeric material sandwiched between the upper end of the valve housing and the lower surface of the top of the boss. There is a passageway in the elastomeric gasket aligned with the opening of the boss so that the stem of a sprayhead may be slidably and sealingly engaged therein. There is a valve plunger in the housing which is spring-biased against the gasket member, the stem of the sprayhead engaging in a socket formed in the plunger, the upper edge of the plunger serving as a valve seat to control whether or not pressurized product will pass from the interior of the package by way of a dip tube to the valve housing, over the valve seat and into the hollow bore of the stem and thence to the button of the sprayhead.

The construction described is disclosed in U.S. Pat. No. 2,777,735. In this patented construction, the stem of the sprayhead has a slot in its side wall which extends axially along the stem from the bottom end thereof to just above the valve seat so that it enters the gasket. Pressing down on the button exposes the upper end of the slot below the elastomeric gasket member so that the pressurized product enters into the bore of the stem only by way of the exposed portion of the slot. Thus, the cross section of the slot entrance controls the rate at which pressurized product is passed to the hollow bore of the stem and out the external opening of the button. This is called metering, in the art.

The so-called slotted stem sprayhead has enjoyed substantial success, especially in handling products which have heavy materials in suspension, such as for example waxes, paints and the like. One problem which arose in such valves concerned the control of metering. Two factors would alter the metering which was built into the stem of the sprayhead. One was the constricting force of the elastomeric gasket tending to close the slot and the other was the swelling of the resinous material from which the sprayhead was molded. In both cases, the tendency of the slot was to close, substantially changing the metering and often even closing the slot so that very little if any of the product could be passed. This was especially true in the case of very fine metering where the slot initially was quite small. Because of the above factors, sprayheads of this type were made out of some synthetic resin which was relatively rigid, such as nylon. Other similar resins used were those sold in the market as trade-marked products "Delrin" and "Celcon," these also being relatively rigid. The degree of cold flow of this type of synthetic resin is less than the softer resins, among which are polyethylene and polypropylene. The cost of the softer resins is substantially less than that of the rigid resins, but the latter were needed in order to maintain the metering dimensions molded into the stems. Polypropylene is a soft resin but somewhat more expensive than polyethylene although more economical than the rigid resins or plastics, as they will be referred to herein.

Two constructions were devised to obviate the problem of collapsing slots, one of which consisted of placing a small strengthening web in the upper end of the slot, and the other of which was to provide an interior gallery in the socket of the plunger so that the slot of the stem need not enter the elastomeric gasket. The first of these constructions is disclosed in U.S. Pat. No. 3,045,877 and the second of these constructions is disclosed in U.S. Pat. No. 3,233,792.

While these constructions at least partially solved the problem of relieving the section of the stem where the slot is from the constricting forces of the elastomeric gasket, the problem of swelling was still present. Additionally, molding sprayheads with metering slots is expensive because of the complexities of the molds and the need for maintenance and repair. Additionally, for every different type of metering the molds must be different. Since the part of the sprayhead which is involved is so small, the difficulties involved should be obvious.

The invention achieves advantages over the prior art, especially for cases where the metering is fine, by using a construction that provides a sprayhead in which the stem is imperforate and hence is more economical. The molds for the sprayheads are all simple to manufacture and are all the same irrespective of the metering. Additionally, instead of being molded of rigid resins, these sprayheads can be made of the softer resins of which polyethylene and polypropylene are examples. Considerable savings are achieved by using the more economical of the resins, i.e., the soft resins.

The invention is applicable to stem valves by means of a novel construction. Stem valves are disclosed in U.S. Pat. Nos. 3,266,678 and 3,348,743, although in the latter patents the stem was of complex structure utilizing metering slots molded therein. According to the invention herein, the stem is independently molded without any perforations therein and hence is capable of being made for all meterings without change. The stem valve of the invention may also use a soft resin button which gives advantages in cost.

SUMMARY OF THE INVENTION

According to the invention, a valve structure is provided in which the interior wall of the valve plunger is provided with channel means having predetermined cross-sectional dimensions so that the metering of the valve is known. The stem of the sprayhead is imperforate, being either permanently engaged in the socket or removable therefrom, depending upon whether the structure is intended to be used as a stem valve type or a removable sprayhead type. In this manner, the metering is controlled by the cross-sectional dimensions of the passageways formed between the outer wall of the stem and the channels provided in the inner wall of the socket of the valve plunger. In the case of the removable sprayhead type of valve structure, the entire sprayhead can be made of the more economical soft plastic, such as polyethylene. In the case of the stem valve structure, at least the button of the sprayhead may be made of this more economical plastic. In both cases, the metering is accurately maintained throughout the life of the pressurized package and the molding of the parts for the valve structure is more economical than in the case of prior art structures.

BRIEF DESCRIPTION OF THE DRAWINGS

FIG. 4 is a fragmentary view on an enlarged scale of a portion of FIG. 2, illustrating the relationship of the parts during the time that the sprayhead has been depressed and pressurized product is being dispensed;

FIG. 5 is a perspective view in elevation of the valve plunger of the structure illustrated in FIGS. 2, 3, and 4;

FIG. 6 is a top plan view of the valve plunger of FIG. 5;

FIG. 7 is a median sectional view of the valve plunger of FIG. 5 taken along the line 7—7 of FIG. 6 and in the indicated direction;

FIG. 8 is a fragmentary sectional view taken generally along the line 8—8 of FIG. 7 and in the indicated direction;

FIG. 9 is a fragmentary sectional view taken generally along the line 9—9 of FIG. 6 and in the indicated direction;

FIG. 10 is a view similar to that of FIG. 7 but in this case, the construction is somewhat modified in that there is no gallery provided. Instead, the socket of the plunger has the same configuration from the bottom to the top edge thereof;

FIG. 11 is a fragmentary sectional view taken generally along the line 11—11 of FIG. 10 and in the indicated direction;

FIG. 12 is a view similar to that of FIG. 2 but illustrating a modified form of the invention in which the valve housing is metal and the valve is of the stem type;

FIG. 13 is a fragmentary sectional view taken through the structure of FIG. 12 along the line 13—13 and in the indicated direction;

FIG. 14 is a fragmentary sectional view taken through a modified form of the invention in which there is a footing provided in the floor of the valve plunger socket to space the stem above the floor;

FIG. 15 is a sectional view taken generally along the line 15—15 of FIG. 14 and in the direction indicated;

FIG. 16 is a sectional view taken generally along the line of 16—16 of FIG. 15 and in the direction indicated, this view being rotated 90° relative to the view of FIG. 14;

FIG. 17 is a fragmentary sectional view taken through a modified form of the invention in which a well is provided in the floor of the socket of the valve plunger; and FIG. 18 is a sectional view taken generally along the line 18—18 of FIG. 17 and in the indicated direction.

DESCRIPTION OF THE PREFERRED EMBODIMENTS

As previously indicated above, the invention is applicable to either the stem valve type of structure or to the structure in which the entire sprayhead is removable in the manner taught by U.S. Pat. No. 2,777,735. Likewise, it will be seen that the invention is applicable to structures which use a gallery and those which do not.

IN FIGS. 1 through 9, there is illustrated a type of valve construction in which the sprayhead is fully removable, there is a gallery in the upper wall of the socket of the valve plunger, and in which there is a plastic valve housing.

Figure 1:
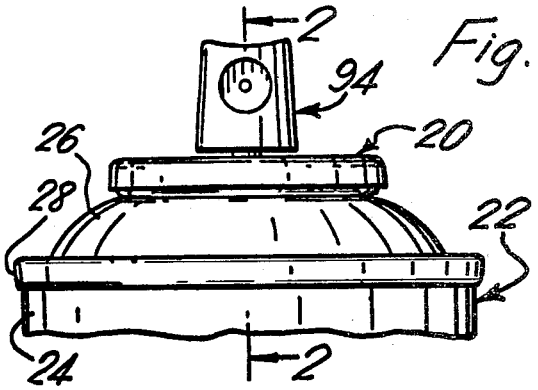
FIG. 1 is a fragmentary elevational view of the upper end of a pressurized package of the type in connection with which the invention is used.

The valve assembly of the invention is designated by the reference character 20. This valve assembly 20 is purchased by the filler who puts it together with a canister 22 to make up the pressurized package, filling it with the propellant either before or after he installs the sprayhead or spray button, depending upon his techniques. FIG. 1 shows a canister 22 which has a cylindrical body 24 that is held to a metal pressure dome 26 by a locked and sealed seam 28. The upper end of the dome 26 provides an opening or mouth 30 that has a rolled or curled formation 32. The valve assembly 20 is adapted to be mounted in the opening 30 and crimped in place as by the crimp 34, the seal being effected by the joint to be described.

The valve assembly 20 includes a metal cover member 36 that has an annular well 38 that surrounds an upstanding central boss 40 that is integral with the floor of the well and is formed from the same integral sheet metal member that constitutes the cover member 36. The upper edge of the cover member 36 is rolled as shown at 42 and this rolled edge engages over the rolled formation 32 surrounding the mouth 30 of the dome 26. A layer of gasketing material 44 between the rolled edges seals the cover member 36 into the opening 30 of the canister 22.

The valve assembly 20 includes a valve housing 46 which is often called an eyelet in the trade, this housing in the structure being described being made out of some suitable plastic and having its upper end flared or enlarged to provide the flange 48 that engages into the boss 40 and is locked in place by means of the crimps 50. A disc-like elastomeric gasket 52 is compressed by the flange 48 against the inside of the upper wall 54 of the boss 40 so that the gasket 52 is sandwiched between the flange 48 and the upper wall 54. The upper wall 54 of the boss 40 has a central opening 56 and the gasket 52 likewise has a central passageway 58 that is aligned with the opening 56.

On its interior, the valve housing 46 provides a chamber 60 into which pressurized product is adapted to be introduced by way of the dip tube 62 that is locked to the bottom end of the housing 46 by any suitable means such as the split locking collar 64. The exact construction of this locking means is described in U.S. Pat. No. 3,159,318. Any other method of securing the dip tube 62 may be used. In the chamber 60 there is a valve plunger 66 which provides a shoulder 68 and pilot projections 70 to seat a helical spring 72 that urges the plunger 66 upwardly as viewed, against the bottom surface of the gasket 52. The interior of the plunger 66 provides a socket 74 which has a blind bottom end which forms a floor 76, as best seen in FIGS. 6 to 9.

Figure 2:
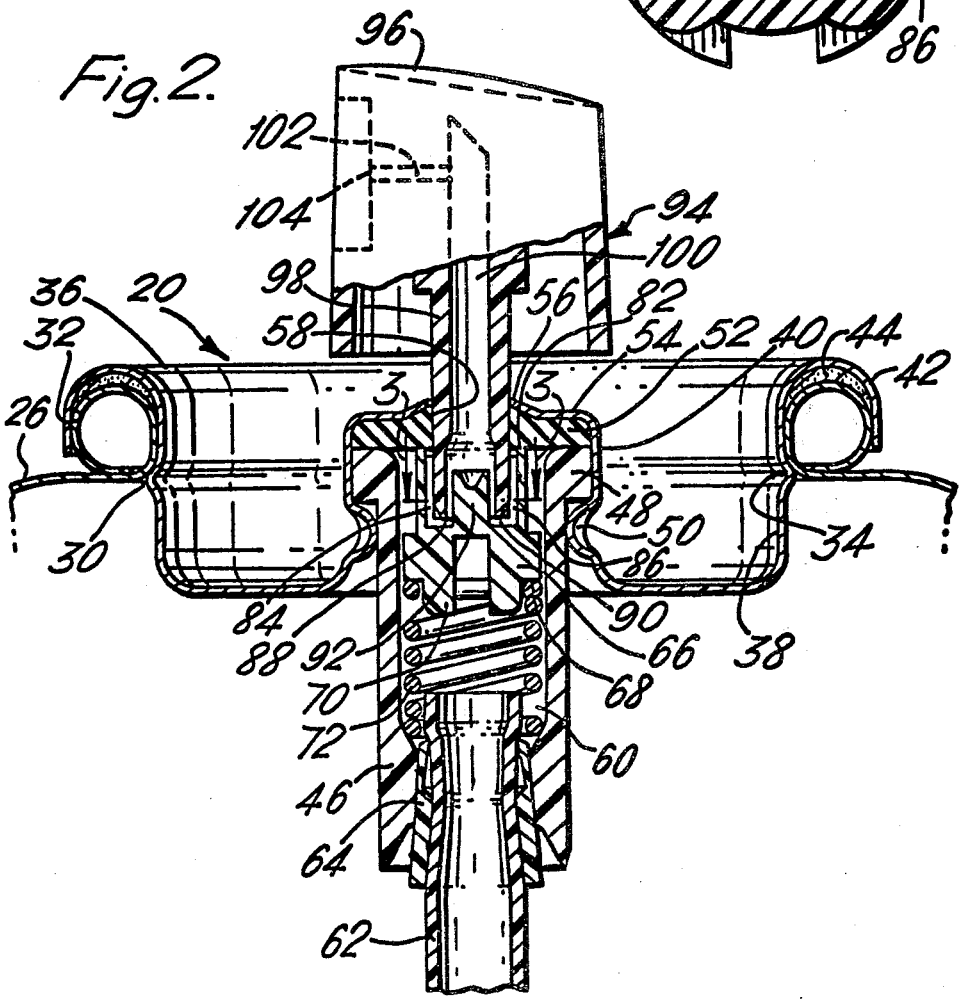
FIG. 2 is a fragmentary median sectional view taken through the package of FIG. 1 along the line 2—2 and in the indicated direction, the valve construction including a removable sprayhead and a plastic valve housing.

The upper end of the socket 74 has a gallery 78 that extends around the interior thereof, giving rise to a narrow section 80 that has an end surface 82. This end surface 82 is that which engages tightly against the bottom surface of the elastomeric gasket 52 as best seen in FIG. 2 and comprises the valve seat. When the valve plunger 66 moves off the gasket 52 as by being pushed downwardly, pressurized product from the chamber 60 will pass over the seat 82 and into the gallery 78, as best shown in FIG. 4. The interior of the socket 74 has channels 84 and 86 formed therein, these channels opening at their upper ends into the gallery 78 and extending slightly below the floor 76 at their bottom ends. The channels 84 and 86 extend generally axially of the valve plunger 66, considering that its axis is vertical in FIGS. 2,4 being the geometric center of the valve plunger as viewed, for example, in FIGS. 3 and 6. There are continuations of the bottom ends of the channels 84 and 86 formed in the floor 76, these comprising radially extending grooves 88 and 90, respectively. The radially innermost ends of the grooves 88 and 90 end at the center post 92, this post being integral with the valve plunger 66 and extending upwardly from the floor 76.

Figure 3:
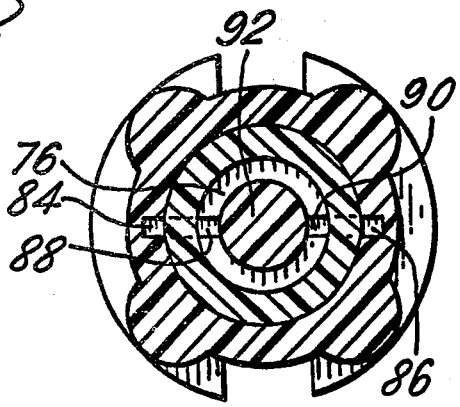
FIG. 3 is a sectional view taken generally along the line 3—3 of FIG. 2 and in the indicated direction.

A sprayhead 94 is mounted in association with the valve assembly 20, the sprayhead comprising a button 96 with an integral, hollow bore stem 98 depending from the bottom of the button. The stem 98 has a central expansion chamber 100 which leads to a transverse passageway 102 in the button 96 connecting the external spray orifice 104 with the said chamber 100. The bottom end of the stem 98 has a slight chamfer at 106 as shown in FIG. 4 to assist in guiding the stem through the gasket 52 and into the socket 74 when the sprayhead 94 is assembled to the valve assembly 20. At its bottom end, the interior hollow chamber 100 is of such diameter that it clears the post on the interior of the stem by a substantial amount, as best seen in FIGS. 3 and 4. As for its exterior dimension, the diameter of the stem 98 is such as to provide a relatively tight sliding fit with the socket 74. In this manner, since the stem 98 is imperforate except at its axial bottom end, no pressurized product can escape from the valve chamber 60 except by way of the channels 84 and 86 and their grooves 88 and 90.

In prior structures, the post 92 has served as an assist in guiding and seating the stem in the bottom of the socket, and in such cases, the outer diameter of the post was the same as the inner diameter of the bore of the stem. In this case, since it is required that there be a space to enable the pressurized product to enter the lower end of the expansion chamber 100 and move past the post 92, the outer diameter of the post 92 is substantially less than the inner diameter of the bore 100. The primary purpose for the post in the construction which is illustrated is to enable gassing the pressurized package by the apparatus and method disclosed in U.S. Pat. No. 3,386,479. Otherwise, the post 92 is not essential to the operation of the valve structure.

The operation of the aerosol valve of the invention is best described in connection with FIGS. 2 and 4. In FIG. 2 the valve is closed, with the valve seat 82 tightly pressed against the underside of the gasket 52. Under these circumstances no pressurized product can escape from the valve chamber 60. The entire sprayhead 94 may be removed from the valve assembly 20 if desired without affecting the inoperative condition. This provides certain advantages which are common with the construction of the valve structure of U.S. Pat. No. 2,777,735.

With the sprayhead 94 in place, when it is desired to dispense pressurized product, the button 96 is pressed downward and the lower end of the stem 98 engaging against the floor 76 of the socket 74 of the valve plunger 66 forces the plunger downward against the bias of the spring 72 to the position which is illustrated in FIG. 4. When this occurs, pressurized product generally follows the lines of the arrows illustrated in FIG. 4. It rises in the chamber 60 to the top of the plunger 66, passes over the valve seat 82 and into the gallery 78. From the gallery 78, the pressurized product passes down the channels 84 and 86 to the grooves 88 and 90, these latter being formed in the floor 76. The pressurized product now passes the end of the stem 98 and moves to the interior bore of the stem, passing upward between the inner surface of the stem 98 and the outer surface of the post 92 into the expansion chamber 100 and thence out to the atmosphere by way of the passage 102 and the orifice 104.

To discontinue the spraying of the aerosol product, the button 96 is released by the user and the sprayhead 94 moves upwardly because of the spring 72, thereby closing the valve due to the valve seat 82 once more engaging against the underside of the gasket 52.

while there are advantages in having a gallery as 78 in connection with the apparatus, it is not essential to the operation of the invention, and the principal advantages are achieved without the use of a gallery. For example, in FIGS. 10 and 11 the gallery is omitted. In this case, the valve plunger 110 is constructed in the same manner as the valve plunger 66 of FIGS. 1 through 9, except that the channels 112 and 113 which are the equivalent of the channels 84 and 86 respectively of the valve assembly 20 end at the valve seat 114 The valve seat 114 is substantially wider than the valve seat 82, since it is formed by the upper end of the wall 116 which forms the socket 118 of the plunger 110.

From the above description, it will be noted that the stem 98 of the sprayhead 94 is imperforate except where its hollow bore 100 opens to the bottom of the stem. There are no holes or slots to be molded into the stem, making its manufacture economical on account of relatively simple molds. Further, since there are no slots or holes which control the metering of the valve structure, only one design of sprayhead is needed for all meterings of valve structures. The metering is provided elsewhere. Since there are no holes or slots, and no tolerances to be maintained to preserve metering, the sprayhead may be molded from the economical soft plastics instead of the expensive rigid plastics. As stated previously, such economical plastics are, for example, polyethylene. This is more economical than nylon, Delrin, Celcon or other rigid plastics.

The metering is established by the dimensions of the channels 84 and 86 in the case of the valve assembly 20 and the equivalent channels 112 and 113 of the structure illustrated in FIGS. 10 and 11. The passageway defined by the channels and the exterior surface of the stem 98 will control metering, the total rate being the sum of the cross sections of both channels in each case. Two channels are shown in the structures described, but obviously for greater flow rates, more than two channels can be used. Obviously there will have to be additional grooves cut in the floor of the socket as well. Under some circumstances, even a single channel with floor groove could be sufficient. Since the interior of the valve plunger is not subjected to constricting pressures, the channels are not likely to close down. Further, since the channels and grooves are fully backed up and are in a member having greater diameter than the stems swelling or other stress is less likely to affect the dimensions of the channels and grooves. Accordingly, the metering is more accurate and will remain accurate over the lifetime of use of the pressurized package. Also, this type of structure is more economical to mold than the stems with slots because the molds are not as complicated.

FIGS. 12 and 13 illustrate another form of the invention which differs from the structures thus far described in which the sprayhead is formed of two parts, namely the stem and the button. The valve assembly is also made somewhat differently to illustrate the fact that the invention is capable of considerable variation in its embodied form.

The valve assembly 120 is shown in FIG. 12 comprising a cover member 122 of metal and a central boss 124 also of metal, as in the case of the structure of FIGS. 2 and 4. The eyelet or valve housing 126 in this case is also of metal instead of plastic. It has the flanged upper portion 128 which is crimped in place by the crimps 130 sandwiching the elastomeric gasket 132 between the flange 128 and the lower face of the upper part 134 of the boss 124. The valve plunger 136 is again biased upward by a spring 138 and the construction of the plunger is not substantially different from the plungers 66 and 110 previously described. The pressurized product is led from the interior of the canister to the chamber 140 formed in the valve housing 126 by way of a dip tube 142 whose upper end is crimped to the bottom of the valve housing 126 at 144.

The sprayhead 146 in this instance is made up of a button 148 and a separate stem 150. The stem 150 is forced into a permanent engagement with the socket 152 of the valve plunger 136, there being a slight ridge 154 on the interior of the socket designed to engage the outer surface of the stem to hold the same in place. Such ridges are readily molded in synthetic resins and are soft enough during the molding process to enable removability from the mold. These ridges will regain their shape immediately after the pieces are removed from the mold. The pressure of the ridge causes cold flow of the stem wall where engaged and the resulting joint is quite tight. The valve plunger 136 has a gallery 156 and valve seat 158. Axially extending channels 160 and 162 are provided in the interior of the socket 152 connecting with a groove 164 formed diametrically in the floor 166.

It will be noted that there is no post in the center of this valve plunger 136 like the post 92 of the previously described structure. The gassing of pressurized packages having stem valves is done by techniques which differ from those used to gas pressurized packages that have removable sprayheads. In this case, since the stem 150 is permanently secured within the valve plunger 136 and will protrude from the boss 124 at all times, the button 148 being removable therefrom, there is no need for a central filling post. For this reason, the groove 164 in the floor 166 may extend fully across the floor.

The stem is best molded from the rigid plastic material discussed above, but the button 148 is easily molded from economical soft plastics of the polyethylene type. The remainder of the construction is obvious from FIGS. 12 and 13, and the operation is simply the depressing of the button 148 to move the valve seat 158 downwardly off the surface of the elastomeric gasket 132 against the bias of the spring 138. Release of the button closes the valve.

In FIGS. 14, 15 and 16 there is illustrated a form of the invention in which there is no groove in the floor. Instead, there are ridges or footing to space the bottom end of the stem above the floor to permit the pressurized product to enter the bottom of the bore 196 of the stem. There is no need to extend the axial channels below the level of the floor. As shown, the valve plunger 170 has the socket 172 formed therein into which the lower end of a removable stem 174 is slidably fitted. There is a gallery 176 which is formed just below the valve seat 178 at the upper end of the wall 180. The channels 182 and 184 are formed in the wall inside of the socket 172 and these open at their upper ends into the gallery 176, but their lower ends terminate at the floor 186. In this construction, since the stem 174 is intended to be integral with the button of the sprayhead, the post 188 is provided to enable gassing by the technique mentioned above.

In the absence of grooves in the floor 186, means are required to space the bottom end of the stem 174 above the floor so that the pressurized product will move from the channels 182 and 184 past the stem wall to its center bore. For this purpose ridges 190 and 192 are molded integral with the floor 186 so that the stem bottom stands off the floor as best seen in FIG. 14. In the event that the post 188 were not used, the ridges 190 and 192 could be combined to extend fully across the floor. Small protrusions from the floor or side wall in place of these ridges would perform the same function.

In FIGS. 17 and 18 there is illustrated a form of the invention in which the valve plunger 200 has a stem 202 engaged in the socket 204 thereof without a center post. This could be either a permanent connection as, for example, in the case of a stem valve or the stem 202 could be integrally connected with a spray button. The channels 206 and 208 are provided in the socket in the wall 210 with their upper ends opening into a gallery 212 and their lower ends extending below the floor 218 and opening to the grooves 214 and 216, respectively. These grooves are shown slanting slightly downward toward the center of the floor and terminating in a relatively large well 220. The purpose of this well is to accumulate drainage of residue between uses of the aerosol package. In this way, heavy materials which might be suspended in the propellant and which adhere to the walls of the stem 202 and in the channels 206 and 208 will drain down into the well 220, thus decreasing the possibility of clogging the channels or grooves. The same effect can be achieved in some of the other forms of the invention by deepening the grooves formed in the bottom of the floor.

The invention is applicable to the so-called tilt type of valves. In these valves the opening in the cover member such as for example opening 56 of the assembly 20 of FIGS. 1 to 9, is slightly larger in diameter than for a sprayhead that only slides vertically. Thus, tilting can be accomplished. Additionally, the upper end of the valve plunger is enlarged to provide a valve seat that is much larger in diameter than those shown. This enables a fulcrum effect during tilting of the sprayhead. The metering in such tilt valves will be built into the plunger structure exactly as described hereinabove.

The embodiments of the invention may have many modifications without departing from the spirit or scope of the invention as defined in the appended claims.

What it is desired to secure by Letters Patent of the United States is:

1. A valve structure for a pressurized package, comprising:

A. a cover member adapted to be installed in said package,

B. a housing connected to the bottom of the cover member and being enclosed but for a first opening through the cover member and a second opening adapted to communicate with the interior of the package, C. an elastomeric gasket between the housing and the cover member and having a passageway aligned with the first opening, D. a valve plunger in the housing spring-biased against the elastomeric gasket and when so biased blocking passage of pressurized product from the interior of the housing to the exterior of the cover member, said valve plunger comprising 1. a body having a cylindrical wall defining a central upwardly opening socket with a blind bottom floor and including a central upwardly extending center post, 2. the cylindrical wall having a valve seat at its upper end around the upper entrance of the socket, 3. channel means in the interior of the socket in said wall extending generally axially of the cylindrical wall, opening at the upper end thereof adjacent the valve seat and opening at the bottom end adjacent said floor, E. a sprayhead consisting of an exterior push button and a hollow stem, the stem passing through the first opening and the passageway of the elastomeric gasket in a sealing and sliding engagement and having the exterior of the wall thereof sealingly engaged in said socket and extending substantially to the bottom floor thereof, the lower part of said stem wall being imperforate and having an axial end opening, and F. the lower end of the socket having means providing passage from the bottom end of said channel to the axial end opening of the stem, the pressurized product adapted to be conveyed from the interior of the housing over the valve seat when the push button is depressed and then to pass by way of said channel means to the bore of the stem and thence out to the atmosphere by way of said push button, said push button having an external orifice communicating with said bore.

2. A valve structure as claimed in claim 1 in which said last-mentioned means comprise groove means in the floor communicating with the bottom end of said channel means, the lower end of the stem wall is in engagement with said floor, and said groove means extend from said channel means to the axial end opening past the lower end of the stem wall.

3. A valve structure as claimed in claim 1 in which said last-mentioned means comprise footing means spacing the lower end of the stem wall above the floor.

4. A valve structure as claimed in claim 1 in which the stem and push button are separable and the stem is substantially permanently engaged in said socket.

5. A valve structure as claimed in claim 1 in which the stem and push botton are integral and the stem is removably engaged in the socket.

6. A valve structure as claimed in claim 2 in which stem and push button are integral and the stem is removably engaged in the socket.

7. A valve structure as claimed in claim 1 in which there is a gallery at the upper end of the plunger and the upper end of the channel means open into the gallery, the gallery being disposed below the valve seat.

8. A valve structure as claimed in claim 2 in which means are provided to accumulate residue in the floor of the socket without interfering with passage of pressurized product by way of said channel means and groove means.

* * * * *